US006622630B2

(12) United States Patent
Yang et al.

(10) Patent No.: US 6,622,630 B2
(45) Date of Patent: Sep. 23, 2003

(54) BOOSTER

(75) Inventors: Wenbo Yang, Sugar Land, TX (US); Jason H. Mai, Houston, TX (US); Lawrence A. Behrmann, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/546,160

(22) Filed: Apr. 11, 2000

(65) Prior Publication Data

US 2002/0139274 A1 Oct. 3, 2002

Related U.S. Application Data

(60) Provisional application No. 60/129,749, filed on Apr. 16, 1999.

(51) Int. Cl.[7] ..... C06O 5/00; C06O 5/04

(52) U.S. Cl. ..... 102/275.4; 102/275.6; 102/275.7; 102/275.8; 102/275.5

(58) Field of Search ..... 102/275.4, 275.7, 102/275.9, 275.6, 275.11–12, 275.5, 275.8

(56) References Cited

U.S. PATENT DOCUMENTS 2,535,518 A * 12/1950 Rich ..... 102/275.4
2,618,221 A * 11/1952 Lowe ..... 102/275.4
2,923,239 A * 2/1960 Andrew et al. ..... 102/275.4
4,735,145 A * 4/1988 Johnson et al.
4,998,477 A * 3/1991 Barker ..... 102/275.6
5,503,077 A * 4/1996 motley
5,631,440 A * 5/1997 Thureson et al. ..... 102/275.7
6,047,643 A * 4/2000 Benner et al.
6,397,752 B1 * 6/2002 Yang et al. ..... 102/275.4

FOREIGN PATENT DOCUMENTS

| | | |
|---|---|---|
| GB | 257 649 A | 5/1925 |
| GB | 579 281 A | 7/1946 |
| GB | 708 422 A | 5/1954 |
| GB | 2 246 620 A | 2/1992 |
| WO | WO 90/07689 | 7/1990 |

* cited by examiner

*Primary Examiner*—Michael J. Carone
*Assistant Examiner*—Lulit Semunegus
(74) *Attorney, Agent, or Firm*—Trop, Pruner & Hu P.C.; Jeffery E. Griffin; Brigitte L. Jeffery

(57) ABSTRACT

A booster to relay a detonation train from a detonating cord to another booster includes an explosive and a shell. The shell has an open end to receive an end of the detonating cord and an indented closed end that is adapted to form a projectile to strike the other booster when the explosive detonates. The explosive may include at least fifty percent by weight of NONA, and in some embodiments, the explosive may be primarily NONA.

41 Claims, 2 Drawing Sheets

BOOSTER

This application claims the benefit, under 35 U.S.C. §119, of U.S. Provisional Patent Application Ser. No. 60/129,749, entitled, "BOOSTER," filed on Apr. 16, 1999.

BACKGROUND

The invention relates to a booster, such as a booster that is used to transfer a detonation train between two detonating cords, for example.

A perforating gun typically is used to form tunnels in a formation to enhance the production of oil and/or gas from the formation. The tunnels are formed by detonating shaped charges of the perforating gun. In this manner, the shaped charges typically detonate in response to a shockwave, or detonation train, that propagates along a detonating cord (often called a primer cord) that contacts the shaped charges. Quite often, several perforating guns may be used to perforate the formation(s) of a wellbore in one firing sequence. As a result, the detonation train may be relayed from one perforating gun to the next, a condition that implies the detonation train is relayed between the detonating cords of the different perforating guns. One way to accomplish this is to tie the ends of the detonating cords together. However, such an arrangement may be too susceptible to failure.

Secondary explosives may be used to more effectively transfer a detonation train between two detonating cords, as the secondary explosives amplify, or boost, the detonation train due to the nature of the transfer. For example, referring to FIG. 1, a pair of detonating boosters 10 (a donor booster 10*a* and a receptor booster 10*b*) use secondary explosives to transfer a detonation train from one detonating cord 12 to another detonating cord 14. To accomplish this, the detonating booster 10 may include an explosive 20 that is located near a closed flat end 24 of a tubular shell 22. An open end 21 of the shell 22 receives an end of the detonating cord 12, 14 that ideally contacts the explosive 20. The explosive 20 in the donor booster 10*a* detonates in response to a detonation train from the detonating cord 12, an event that causes the end 24 of the shell 22 to break into several projectiles. If the receptor booster 10*b* is close enough to the donor booster 10*a*, the projectiles strike the end of the receptor booster 10*b* and detonate its explosive 20. The detonation of the explosive 20 of the receptor booster 10*b*, in turn, introduces a detonation train to the detonating cord 14 to complete the transfer of the detonation train. As depicted in FIG. 1, the donor 10*a* and receptor 10*b* boosters may be identical. Due to this feature, either booster 10 may be used as the donor booster, thereby making it difficult to make errors when assembling the donor and the receptor boosters 10. Not shown in FIG. 1 is a housing that typically is used to hold and position the donor 10*a* and receptor 10*b* boosters.

Due to the tolerances of other parts of the perforating gun (e.g., tolerances introduced by loading tube for shaped charges, connections, booster housing, etc.), it is difficult to have a fixed booster-to-booster air gap 40 between the ends 24 of the donor 10*a* and receptor 10*b* boosters. Because the projectiles from the donor booster 10*a* tend to spread apart during flight, the success of the detonation train transfer may be sensitive to the span of the air gap 40. Therefore, if the air gap 40 is too large, the projectiles may spread too far apart and not sufficiently contact the receptor booster 10*b* to cause detonation of its explosive 20.

Referring to 2, the success of the detonation train transfer may also be sensitive to a cord-to-booster air gap 43 that may exist between the end of the detonating cord 12, 14 and the explosive 20. This gap 43 may be attributable to, as examples, an uneven cut in the detonating cord 12, 14 or assembly error. Unfortunately, if the span of the air gap 43 is too large, the detonation train transfer may fail. For example, for the donor booster 10*a*, if the span is too large, a detonation train from the detonating cord 12 may not detonate the explosive 20, and for the receptor booster 10*b*, if the span is too large, the detonation of the explosive 20 may not initiate a detonation train on the detonating cord 14.

Thus, there is a continuing need for an arrangement that addresses one or more of the above-stated problems.

SUMMARY

In one embodiment of the invention, a booster to relay a detonation train from a detonating cord to another booster includes an explosive and a shell. The shell has an open end to receive an end of the detonating cord and an indented closed end that is adapted to form a projectile to strike said another booster when the explosive detonates.

In another embodiment of the invention, a booster to relay a detonation train from a detonating cord to another booster includes a shell and an explosive. The shell is adapted to receive an end of the detonating cord, and the explosive is adapted to detonate in response to the detonation train. The explosive includes at least approximately fifty percent of NONA by weight, and the explosive forms at least one projectile out of the shell to strike the other booster when the explosive detonates.

Other features will become apparent from the following description, from the drawings and from the claims.

DETAILED DESCRIPTION

Figure 3:
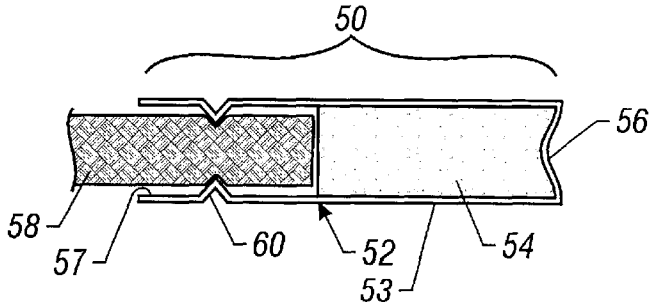
FIG. 3 is a cross-sectional view of a detonating booster according to an embodiment of the invention.
Figure 4:
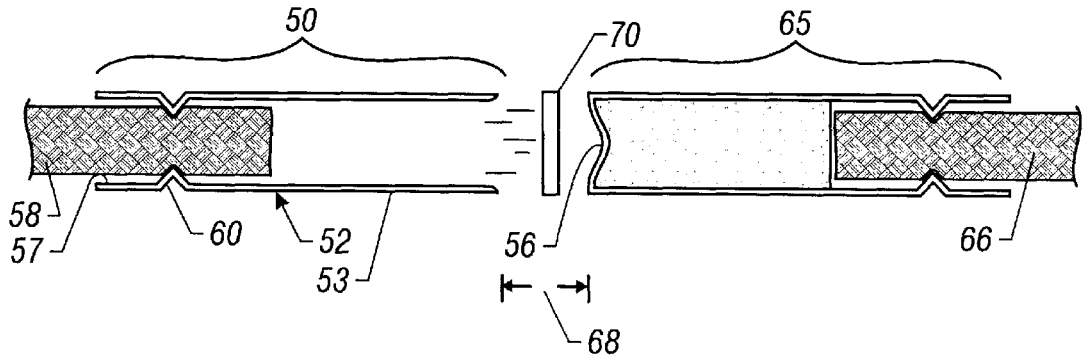
FIG. 4 is an illustration of a projectile formed by the detonating booster of FIG. 3 according to an embodiment of the invention.

Referring to FIGS. 3 and 4, an embodiment 50 of an explosive detonating booster in accordance with the invention may include features that permit greater cord-to-booster and booster-to-booster air gaps than conventional boosters. These features may include a shell 52 (of the booster 50) that is constructed to permit a greater booster-to-booster air gap and may include an explosive 54 (of the booster 50) that permits both a greater booster-to-booster air gap and a greater cord-to-booster air gap, as further described below.

Figure 1:
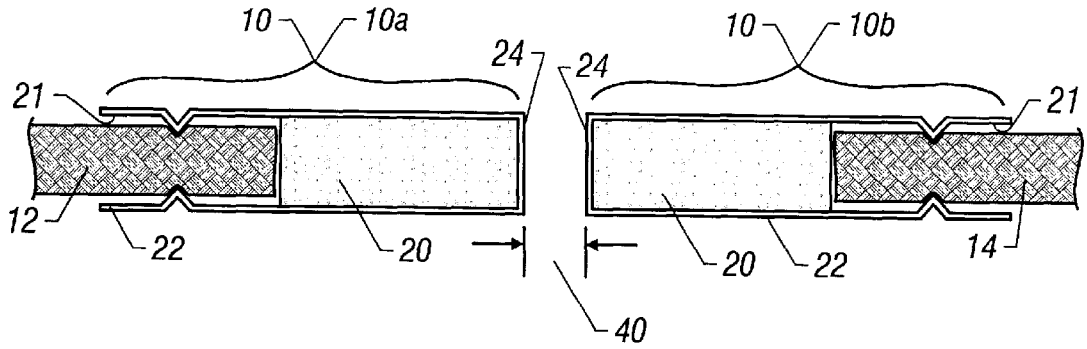
FIG. 1 (Prior Art)
FIG. 1 is a cross-sectional view of a donor detonating booster and a receptor detonating booster of the prior art.
Figure 2:
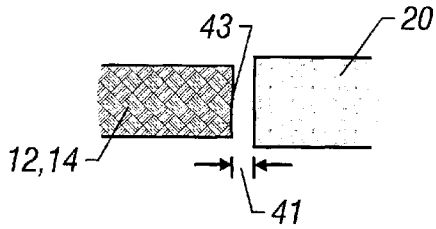
FIG. 2 (Prior Art)
FIG. 2 is an illustration of an air gap between a detonating cord and an explosive of a booster of FIG. 1.
Figure 5:
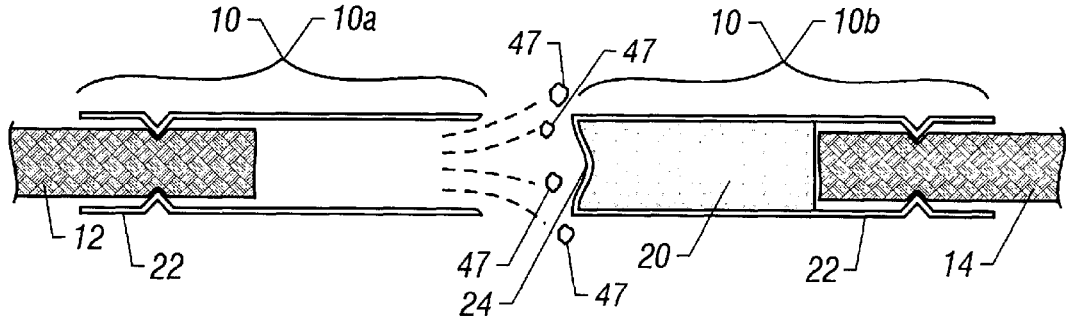
FIG. 5 (Prior Art)
FIG. 5 is an illustration of projectiles formed by a detonating booster of the prior art.

More particularly, the booster 50 may be formed from a generally circularly cylindrical shell 52 that has a closed curved, or indented, end 56 that forms a projectile 70 (see FIG. 4) when an explosive 54 of the booster 50 detonates. The indented end 56 of the shell 52 is to be contrasted to a conventional booster, such as the booster 10 depicted in FIG. 1, that has a flat closed end 24. In particular, after detonation of the explosive, the flat end 24 typically breaks apart to produce a "shotgun pattern" of several projectiles 47, as depicted in FIG. 5. These projectiles 47 may not propagate across a booster-to-booster air gap 68 along an approximate straight line, but rather, the projectiles 47 may spread further apart as the projectiles 47 travel toward the receptor booster 10*b*. As a result, the larger the span of the air gap 68, the less chance that a sufficient number of the projectiles 47 (if any) will strike the receptor booster 10*b*.

In contrast to the flat end 24, the indented end 56 of the shell 52 produces the projectile 70 that is larger than any of the smaller projectiles 47 that is produced by a conventional booster. In some embodiments, the projectile 70 assumes an expanded and substantially planar shape after detonation of the explosive 54, a feature permits sufficient contact with the receptor booster 65 to detonate its explosive. Thus, instead of breaking into several projectiles that scatter over a large area, the piece of the shell 52 that forms the indented closed end 56 remains in substantially one piece after detonation of the explosive 54, travels in a substantially straight path toward the receptor booster 65, and is shaped (in the form of the projectile 70) to maximize contact with the receptor booster 65. Due to these features, the span of the air gap 68 may be larger than the span used with conventional boosters. Due to these features, the span of the air gap 68 may be larger than the span used with conventional boosters.

In the context of this application, the phrase "indented end" or "curved end" generally may include an end that has a smooth surface or an end that is formed in a piecewise fashion from several surfaces.

In some embodiments, the indented end 56 is generally convex with respect to the explosive 54 that is housed by the shell 52, and the explosive 54 is located next to the indented end 56. A detonating cord 58 may be inserted into an open end 57 of the shell 52 so that the end of the detonating cord 58 is located near the explosive 54. When a detonation train propagates down the detonating cord 58 to the explosive 54, the explosive 54 detonates, an event that dislodges the indented end 56 to produce the projectile 70. The projectile 70 travels across the air gap 68 and strikes the receptor booster 65 that, in turn, initiates a detonation train on another detonating cord 66 that is attached to the receptor booster 65.

As an example of a particular design, the indented end 56 may be convex with respect to the explosive 54 and have a near uniform radius of curvature that defines the convexity of the indented end 56. The shell 52 may include a generally circularly cylindrical tube 53 that has the indented end 56 that closes one end of the tube 53 and may include the open end 57 for receiving an end of the detonating cord 58. The explosive 54 is packed inside the tube 53 near the closed end 54. To attach the booster 50 to the end of the detonating cord 58, the end of detonating cord 58 is inserted into the open end 57 of the tube 53 so the end of the detonating cord 58 rests near the explosive 54. After insertion of the detonating cord 58, one or more crimping rings 60 may be formed in the shell 52 (by a crimping tool, for example) to secure the detonating cord 58 in place.

In some embodiments, the cross-sectional diameter of the tube 53 may be approximately one quarter of an inch, and the radius of curvature of the indented end 56 may be approximately two inches. Thus, in some embodiments, the radius of curvature of the indented end 56 may be approximately eight times as large as the cross-sectional diameter of the tube 53. In some embodiments, the shell 52 may be formed out of a metal (aluminum, for example).

The above-described design is an example of one of several possible designs. Other designs, dimensions and shapes may be made and are within the scope of the appended claims. As examples, other dimensions for the radius of curvature of the indented end 56 may be used, other shapes from the indented end 56 may be used, other cross-sectional diameters, other ratios between the above-described dimensions are possible, and other general shapes of the shell are possible.

As depicted in FIG. 4, the receptor booster 65 may have a similar design to the donor booster 50. As a result of this symmetry, either booster may be used as the donor booster, thereby making it difficult to mix the donor and the receptor boosters.

As examples, in some embodiments, the explosive 20 may be an explosive called 2,2-4,4-6,6 hexanitrostilbene (hereinafter referred to as "HNS") or an explosive called cyclotetramethylenetetra-nitramine (hereinafter referred to as "HMX"). Furthermore, in some embodiments, these explosives may be "tipped" by an explosive called 2,2',2",4,4',4",6,6',6"-nonanitroterphenyl (hereinafter referred to as "NONA"), as described below.

Figure 6:
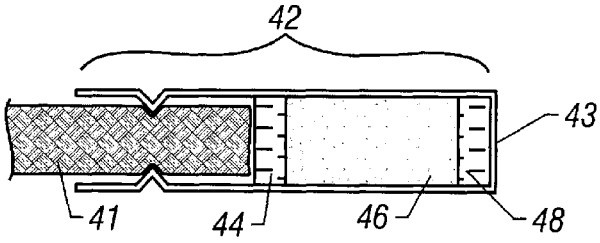
FIG. 6 (Prior Art)
FIG. 6 is a cross-sectional view of a detonating booster of the prior art.

In some embodiments, the explosive 54 may be primarily formed from NONA (one hundred percent NONA, for example), an arrangement that increases the permissible spans of the cord-to-booster and booster-to-booster air gaps, even if the indented end 56 is not used. The primary use of NONA to form the explosive is to be contrasted to conventional arrangements that may use a small amount of NONA to "tip" another explosive. For example, FIG. 6 depicts a conventional booster 42 that uses a small portion 44 (as compared to the total amount of explosive being used) of NONA between the end of a detonating cord 41 and a larger portion of another explosive 46 (HNS, for example) and a small portion 48 of NONA between the explosive 46 and a closed flat end 43 of the booster 42. Thus, each end of the explosive 46 is "tipped" with NONA.

It has been discovered that the use of primarily NONA in the booster 50 may produce a significant performance improvement versus the explosive combinations described above. More particularly, to evaluate the performance gained by using primarily NONA, two tests (described below) were conducted in which NONA was used solely as the explosive 54 in the booster 50. These tests are compared below to tests conducted with conventional boosters (such as the booster 10) that use HMX, HNS and HNS tipped with NONA at both ends as the explosive. For these tests, the booster had a length of about 1.37 inches and a cross-sectional diameter of about 0.25 inches. Approximately 600 milligrams (mg) of explosive(s) were used in the booster for each test.

One test measured a cord-to-booster fifty percent firing gap, a cord-to-booster air gap in which the detonation is successful fifty percent of the time. When HNS was used as the explosive in the conventional booster, the cord-to-booster fifty percent firing gap was determined to be approximately 0.104 inches. When HNS tipped with NONA was used as the explosive in the conventional booster, the cord-to-booster fifty percent firing gap was determined to be approximately 0.150 inches. However, a significant improvement was observed when only NONA was used as the sole explosive in the booster 50, as the cord-to-booster fifty percent firing gap was determined to be approximately 0.410 inches.

Another test measured a booster-to-booster fifty percent firing gap, a booster-to-booster air gap in which the detonation is successful fifty percent of the time. When HNS was used in the conventional booster, the booster-to-booster fifty percent firing gap was determined to be approximately 2.5 inches. When HMX was used in the conventional booster, the booster-to-booster fifty percent firing gap was determined to be approximately 5.0 inches. When HNS tipped with NONA was used in the conventional booster, the booster-to-booster fifty percent firing gap was determined to be approximately 3.0 inches. However, a significant improvement was observed with the booster 50 with the indented end 56 that contained solely NONA, as the booster-to-booster fifty percent firing gap was determined to be approximately 6.0–10.0 inches.

In some embodiments, the explosive 54 may formed from approximately one hundred percent NONA, the percentage used with the booster 50 in the above-described tests. However, other embodiments are possible. For example, in other embodiments, the explosive 54 may include (by weight) approximately fifty percent or more of NONA, approximately sixty percent or more of NONA, approximately seventy percent or more NONA, approximately eighty percent or more of NONA or approximately ninety percent or more of NONA, depending on the particular embodiment.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. A booster to relay a detonation train from a detonating cord to another booster, comprising:

an explosive; and a shell housing the explosive, the shell having an open end to receive an end of the detonating cord and an indented closed end being adapted to form a projectile from the shell to strike said another booster when the explosive detonates, wherein the closed end is formed from a piece of material that is shaped to prevent the piece from substantially disintegrating when the explosive detonates.

2. The booster of claim 1, wherein the closed end is generally convex with respect to the explosive.

3. The booster of claim 1, wherein the shell has a general cross-sectional diameter near the closed end and the convexity of the shell before detonation of the explosive has a radius of curvature that is approximately eight times larger than the cross-sectional diameter.

4. The booster of claim 3, wherein the radius of curvature is approximately two inches.

5. The booster of claim 3, wherein the cross-sectional diameter is approximately one fourth of an inch.

6. The booster of claim 1, wherein the closed end is shaped to cause the projectile to become approximately flat after the explosive detonates.

7. The booster of claim 1, wherein a piece of material forms the closed end and the projectile includes approximately all of the piece.

8. The booster of claim 1, wherein the shell comprises a material that forms a circular cylinder and is shaped to form the indented closed end.

9. A booster to relay a detonation train from a detonating cord to another booster, the booster consisting essentially of:

a shell adapted to receive an end of the detonating cord; and an explosive adapted to detonate in response to the detonation train and including at least approximately fifty percent of NONA by weight to form at least one projectile out of the shell to strike said another booster when the explosive detonates, wherein the shell comprises an indented closed end formed from a piece of material that is shaped to prevent the piece from substantially disintegrating when the explosive detonates.

10. The booster of claim 9, wherein the explosive includes at least approximately sixty percent of NONA by weight.

11. The booster of claim 9, wherein the explosive includes at least approximately seventy percent of NONA by weight.

12. A The booster of claim 9, wherein the explosive includes at least approximately eighty percent of NONA by weight.

13. The booster of claim 9, wherein the explosive includes at least approximately ninety percent of NONA by weight.

14. The booster of claim 9, wherein the explosive includes approximately one hundred percent of NONA by weight.

15. The booster of claim 9, wherein the shell includes a closed indented end that forms said at least one projectile.

16. A method to relay a detonation train from a detonating cord to a booster, comprising:

placing an explosive in a shell;

forming an indented closed end in the shell to form a projectile from the shell to strike the booster when the explosive detonates; and shaping the closed end to cause the projectile to become approximately flat after the explosive detonates.

17. A. The method of claim 16, further comprising:

making the closed end generally convex with respect to the explosive.

18. The method of claim 16, further comprising:

forming a convexity of the shell before detonation of the explosive to have a radius of curvature that is approximately eight times larger than a cross-sectional diameter of the shell.

19. The method of claim 18, wherein the radius of curvature is approximately two inches.

20. The method of claim 18, wherein the cross-sectional diameter is approximately one fourth of an inch.

21. The method of claim 16, further comprising:

forming the closed end is formed from a piece of material; and shaping the closed end to prevent the piece from substantially disintegrating when the explosive detonates.

22. The method of claim 16, further comprising:

forming the closed end out of a single piece of material so that the projectile includes approximately all of the piece.

23. The method of claim 16, further comprising:

forming the shell from a material that is shaped to form a circular cylinder and is shaped to form the indented closed end.

24. A system comprising:

a first boaster coupled to a first detonating cord;

a second booster coupled to a second detonating cord; and wherein the first booster relays a detonation train from the first detonating cord to the second boaster and the first booster comprises:

an explosive; and a shell housing the explosive, the shell having an open end to receive an end of the first detonating cord and an indented closed end being adapted to form a projectile from the shell to strike the second boaster when the explosive detonates.

25. The system of claim 24, wherein the closed end is generally convex with respect to the explosive.

26. The system of claim 24, wherein the shell has a general cross-sectional diameter near the closed end and the convexity of the shell before detonation of the explosive has a radius of curvature that is approximately eight times larger than the cross-sectional diameter.

27. The system of claim 26, wherein the radius of curvature is approximately two inches.

28. The system of claim 26, wherein the cross-sectional diameter is approximately one fourth of an inch.

29. The system of claim 24, wherein the closed end is shaped to cause the projectile to become approximately flat after the explosive detonates.

30. The system of claim 24, wherein the closed end is formed from a piece of material and the closed end is shaped to prevent the piece from substantially disintegrating when the explosive detonates.

31. The system of claim 24, wherein a piece of material forms the closed end and the projectile includes approximately all of the piece.

32. The system of claim 24, wherein the shell comprises a material that forms a circular cylinder and is shaped to form the indented closed end.

33. A method comprising:

connecting a first detonating cord to a first booster;

connecting a second detonating cord to a second booster;

placing an explosive in a shell of the first booster;

forming an indented closed end in the shell to form a projectile from the shell; and striking the second booster with the projectile in response to the detonation of the explosive to relay a detonation train from the first detonating cord to the second detonating cord.

34. The method of claim 33, further comprising:

making the closed end generally convex with respect to the explosive.

35. The method of claim 33, further comprising:

forming a convexity of the shell before detonation of the explosive to have a radius of curvature that is approximately eight times larger than a cross-sectional diameter of the shell.

36. The method of claim 35, wherein the radius of curvature is approximately two inches.

37. The method of claim 35, wherein the cross-sectional diameter is approximately one fourth of an inch.

38. The method of claim 33, further comprising:

shaping the closed end to cause the projectile to become approximately flat in response to the detonation of the explosive.

39. The method of claim 33, further comprising:

forming the closed end is formed from a piece of material; and shaping the closed end to prevent the piece from substantially disintegrating in response to the detonation of the explosive.

40. The method of claim 33, further comprising:

forming the closed end out of a single piece of material so that the projectile includes approximately all of the piece.

41. The method of claim 33, further comprising:

forming the shell from a material that is shaped to form a circular cylinder and is shaped to form the indented closed end.

* * * * *

UNITED STATES PATENT AND TRADEMARK OFFICE

CERTIFICATE OF CORRECTION

PATENT NO. : 6,622,630 B2
DATED : September 23, 2003
INVENTOR(S) : Yang et al.

It is certified that error appears in the above-identified patent and that said Letters Patent is hereby corrected as shown below:

Title page,
Item [74], *Attorney, Agent, or Firm*, delete "Jeffery E." and insert -- Jeffrey E. --.

Column 6,
Line 12, delete "A The" and insert -- The --.
Line 29, delete "A. The" and insert -- The --.

Signed and Sealed this

Eighteenth Day of November, 2003

JAMES E. ROGAN
*Director of the United States Patent and Trademark Office*